US009873592B2

(12) United States Patent
Powers

(10) Patent No.: US 9,873,592 B2
(45) Date of Patent: Jan. 23, 2018

(54) GOVERNOR INERTIA CARRIER FOR ELEVATOR SAFETY MECHANISM

(71) Applicants: ThyssenKrupp Elevator AG, Essen (DE); ThyssenKrupp AG, Essen (DE)

(72) Inventor: Alison Powers, Memphis, TN (US)

(73) Assignee: ThyssenKrupp Elevator AG, ThyssenKrupp AG (DE)

( * ) Notice: Subject to any disclaimer, the term of this patent is extended or adjusted under 35 U.S.C. 154(b) by 153 days.

(21) Appl. No.: 14/878,511

(22) Filed: Oct. 8, 2015

(65) Prior Publication Data

US 2017/0101292 A1 Apr. 13, 2017

(51) Int. Cl.
*B66B 5/04* (2006.01)
*B66B 5/22* (2006.01)

(52) U.S. Cl.
CPC ..... *B66B 5/044* (2013.01); *B66B 5/22* (2013.01)

(58) Field of Classification Search
CPC .. B66B 5/04; B66B 5/044; B66B 5/22; B66B 5/24
See application file for complete search history.

(56) References Cited

U.S. PATENT DOCUMENTS 1,678,031 A * 7/1928 Anderson ..... B66B 5/04 187/375
1,883,164 A * 10/1932 Vassakos ..... F16D 43/206 192/150
3,762,512 A 10/1973 McIntyre
3,985,213 A * 10/1976 Braggins ..... F16D 7/08 192/56.57
4,083,432 A * 4/1978 Lusti ..... B66B 5/04 187/373
5,545,109 A * 8/1996 Hayakawa ..... B21F 15/04 192/150
5,782,319 A 7/1998 Woodruff et al.
(Continued)

FOREIGN PATENT DOCUMENTS

DE 642807 3/1937
JP 2000219450 A 8/2000
(Continued)

OTHER PUBLICATIONS

Thyssenkrupp Northern Elevator, Northern BI and BII Safety Operation Manual, Mar. 18, 2010, pp. 1-15, Toronto, Ontario, Canada.
(Continued)

*Primary Examiner* — Minh Truong
(74) *Attorney, Agent, or Firm* — The Webb Law Firm

(57) ABSTRACT

An elevator governor inertia carrier has a cartridge having a shaft opening for receiving a shaft. The cartridge is configured for fixed attachment to the shaft. At least one force-exerting element is associated with the cartridge and has a hollow body with an internal cavity extending between a first open end and a second end, an elastically-resilient element retained within the internal cavity, and a contact member at least partially disposed within the internal cavity and in contact with an end of the elastically-resilient element. The contact member is retractable into the internal cavity to compress the elastically-resilient element when a force greater than a restoring force of the elastically-resilient element is applied to the contact member.

17 Claims, 7 Drawing Sheets

(56) References Cited

U.S. PATENT DOCUMENTS

| | | | | |
|---|---|---|---|---|
| 6,161,653 | A * | 12/2000 | Skalski | B66B 5/04 187/288 |
| 6,474,579 | B1 * | 11/2002 | Bardos | B02C 13/095 241/186.35 |
| 7,128,189 | B2 * | 10/2006 | Maury | B66B 5/04 187/370 |
| 7,475,756 | B2 * | 1/2009 | Maury | B66B 5/04 187/361 |
| 9,409,748 | B2 | 8/2016 | Mizuno et al. | |
| 2003/0226718 | A1 | 12/2003 | Maury et al. | |
| 2004/0178023 | A1 | 9/2004 | Maury | |
| 2010/0210386 | A1 * | 8/2010 | Long, Jr. | F16D 7/08 474/148 |
| 2014/0216857 | A1 | 8/2014 | Mizuno et al. | |

FOREIGN PATENT DOCUMENTS

| | | | |
|---|---|---|---|
| JP | 200180840 | A | 3/2001 |
| JP | 2009113914 | A | 5/2009 |
| JP | 2009298508 | A | 12/2009 |
| KR | 101227639 | B1 | 2/2013 |
| WO | 0037348 | A1 | 6/2000 |

OTHER PUBLICATIONS

Thyssenkrupp Elevator Americas, Flex Clamp Safeties, Jul. 2011, pp. 1-28, Memphis, Tennessee.

* cited by examiner

GOVERNOR INERTIA CARRIER FOR ELEVATOR SAFETY MECHANISM

BACKGROUND OF THE DISCLOSURE

Field of the Disclosure

The present disclosure relates generally to a system and method for an elevator safety mechanism and, more particularly, to a system and method for a governor inertia carrier used in activating an elevator safety mechanism.

Description of Related Art

In various elevator installations, a safety mechanism is installed on an elevator car to bring the descending elevator car to a stop under certain conditions, such as an uncontrolled descending of the elevator car. The safety mechanism, when actuated, typically operates upon guide rails between which the elevator car is located. The safety mechanism is actuated by a separate speed governor which is set to trip at a predetermined car speed in the down travel direction.

With reference to FIG. 1, an elevator installation equipped with a safety mechanism is shown according to the known state of the art. This installation has an elevator car 10 which is moved between different floors of an elevator shaft (not shown), for example by means of a motor 20 acting on a traction cable or a cluster of traction cables 21. One end of the traction cable or cluster of traction cables 21 is connected to the elevator car 10, while the opposing end of the traction cable or cluster of traction cables 21 is connected to a counterweight 22. The elevator car 10 is guided by a pair of lateral rails 30 extending vertically in the elevator shaft. The elevator car 10 engages the rails 30 through guides 31. For clarity, only one of these rails 30 is shown in FIG. 1.

The elevator installation has a governor assembly having a governor sheave 50 which is mounted in a top potion of the elevator shaft and a governor cable 60 wound between the governor sheave 50 and a tail sheave 51. The governor cable 60 is tensioned by means of a tension weight 52 acting on the tail sheave 51.

The governor cable 60 is fixed to the elevator car 10 by a plate 53, which is also connected to a safety mechanism 15 mounted on the elevator car 10 by a governor rope lever 11. In normal operation, such as when the speed of the elevator car 10 is less than a limit speed, the elevator car 10 drives the governor cable 60. Such movement of the governor cable 60 rotates the governor sheave 50. During normal operation, any stress on the plate 53 by a pulling force due to the inertia of the governor cable 60 may be offset by, for example, one or more holding tension springs.

When the speed of the car 10 reaches or exceeds a limit speed by at least a predetermined amount, such as when the car 10 starts to free fall, the governor sheave 50 locks, such as by actuation of centrifugal weights that engage a toothed fixed cylinder, and the governor cable 60 is immobilized. This causes a pulling force on the plate 53, which actuates the governor rope lever 11, which then acts on the safety mechanism 15 to actuate brakes 12 and 13. The brakes 12, 13, in return, engage the rails 30, such as by clamping against the rails 30, to bring the elevator car 10 to a safe stop.

One of the drawbacks of existing safety mechanisms is that inertia of the governor assembly during normal operation can cause unintended activation of the safety mechanism. During normal acceleration of the elevator car, the inertia of the governor rope 60, the sheaves 50, 51, and the tension weight 52 exerts a force on the governor rope lever 11. In certain circumstances, the inertia of the governor assembly can activate the safety assembly even though the elevator car 10 is operated within the limit speed. One solution to this problem is to use one or more holding tension springs to hold a safety arm connected to the governor rope lever 11 and prevent its unintended engagement until the limit speed is reached or exceeded. However, space surrounding the safety mechanism 15 is critical, and multiple tension springs often require more space than what is available. In addition, the force exerted by the springs increases linearly as the safety mechanism is activated, thereby resulting in large activation forces on various components and linkages of the safety assembly.

It would be desirable to provide a new and improved safety mechanism for preventing unintended activation of the safety mechanism due to inertia of the governor assembly.

SUMMARY OF TILE DISCLOSURE

In view of the disadvantages of the existing safety mechanism, there is a need in the art for an improved safety mechanism that overcomes the deficiencies of the prior art.

In accordance with some embodiments, an elevator governor inertia carrier may include a cartridge having a shaft opening for receiving a shaft through the shaft opening. The cartridge may be configured for fixed attachment to the shaft. The governor inertia carrier may further have at least one force-exerting element associated with the cartridge plate and offset from the shaft opening. The at least one force-exerting element may include a hollow body with an internal cavity extending between a first open end and a second end, an elastically-resilient element retained within the internal cavity, and a contact member at least partially disposed within the internal cavity and in contact with or formed at a first end of the elastically-resilient element. The contact member may be retractable into the internal cavity to compress the elastically-resilient element when a force greater than a restoring force of the elastically-resilient element is applied to the contact member.

In accordance with another embodiment, the second end of the hollow body of the force-exerting element may be open. The second end may be enclosed by an adjustment element that is movably adjustable relative to the hollow body and in contact with a second end of the elastically-resilient element to control compression of the elastically-resilient element between the adjustment element and the contact member. The adjustment element may have a seat for contacting the elastically-resilient element at a first end and a socket for engaging an adjustment tool at a second end. The adjustment element may be movable toward the first end of the hollow body by rotating the adjustment element in a first direction to increase the compression of the elastically-resilient element. The adjustment element may be movable toward the second end of the hollow body by rotating the adjustment element in a second direction opposite to the first direction to decrease the compression of the elastically-resilient element. A locking element may be provided for preventing rotatable movement of the adjustment element relative to the hollow body when the locking element engages at least a portion of the hollow body and the adjustment element.

In accordance with another embodiment, the contact member may have a body with a rounded front end that is extendable from the first end of the hollow body and a radially-outwardly protruding lip that is retained within the interior cavity of the hollow body. A collar may protrude radially-inward from a sidewall of the interior cavity. The collar may have a stop surface that limits a protrusion of the pin from the first end of the hollow body. A detent plate may be facing the bottom surface of the cartridge. The detent plate may have at least one detent shaped to receive the contact member. In a first state, the contact member may be engaged within the detent. In a second state, rotation of the cartridge relative to the detent plate may force the contact member out of the detent and at least partially into the interior cavity of the hollow body. The restoring force of the elastically-resilient element may be preset or adjustable.

In accordance with another embodiment, the cartridge may have one or more through holes extending into the shaft opening. A retention member may be provided in each through hole for engaging at least a portion of the shaft and preventing axial movement of the cartridge on the shaft. The shaft opening may have a recessed portion for receiving a shaft support element. The at least one force-exerting element may be removably or non-removably connected to the cartridge. The shaft may be provided such that the shaft is received within the shaft opening of the cartridge. A housing may be provided for receiving at least a portion of the governor inertia carrier. The detent plate may be fixedly mounted to the housing, and the shaft and the cartridge may be rotatable relative to the housing and the detent plate.

In accordance with another embodiment, a safety mechanism for an elevator may include a housing attachable to at least a portion of an elevator car, a safety activation lever connecting a governor assembly to a rotatable shaft disposed within the housing, a braking assembly activated by a rotation of the shaft, and a governor inertia carrier associated with the shaft and the housing. The governor inertia carrier may have a cartridge having a shaft opening for receiving the shaft through the shaft opening. The cartridge may be configured for fixed attachment to the shaft. At least one force-exerting element may be associated with the cartridge. The at least one force-exerting element may have a hollow body with an internal cavity extending between a first open end and a second end. An elastically-resilient element may be retained within the internal cavity. A contact member may be at least partially disposed within the internal cavity such that a first end of the contact member is in contact with or is formed with the elastically-resilient element and a second end of the contact member received in a detent associated with the housing. The contact member may be retractable out of the detent and into the internal cavity when a force greater than a restoring force of the elastically-resilient element is applied to the contact member.

In accordance with another embodiment, a safety mechanism for an elevator may have a housing attachable to at least a portion of an elevator car, a safety activation lever connecting a governor assembly to a rotatable shaft disposed within the housing, a braking assembly activated by a rotation of the shaft, and a governor inertia carrier associated with the shaft and the housing. The governor inertia carrier may have a spring-loaded contact member received within a detent associated with the housing, wherein the spring-loaded contact member is retractable out of the detent when a force greater than a spring-load force of the spring-loaded element is applied to the spring-loaded contact member.

These and other features and characteristics of a governor inertia carrier used in activating an elevator safety mechanism, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only. As used in the specification and the claims, the singular form of "a", "an", and "the" include plural referents unless the context clearly dictates otherwise.

DETAILED DESCRIPTION OF THE DISCLOSURE

Figure 1:
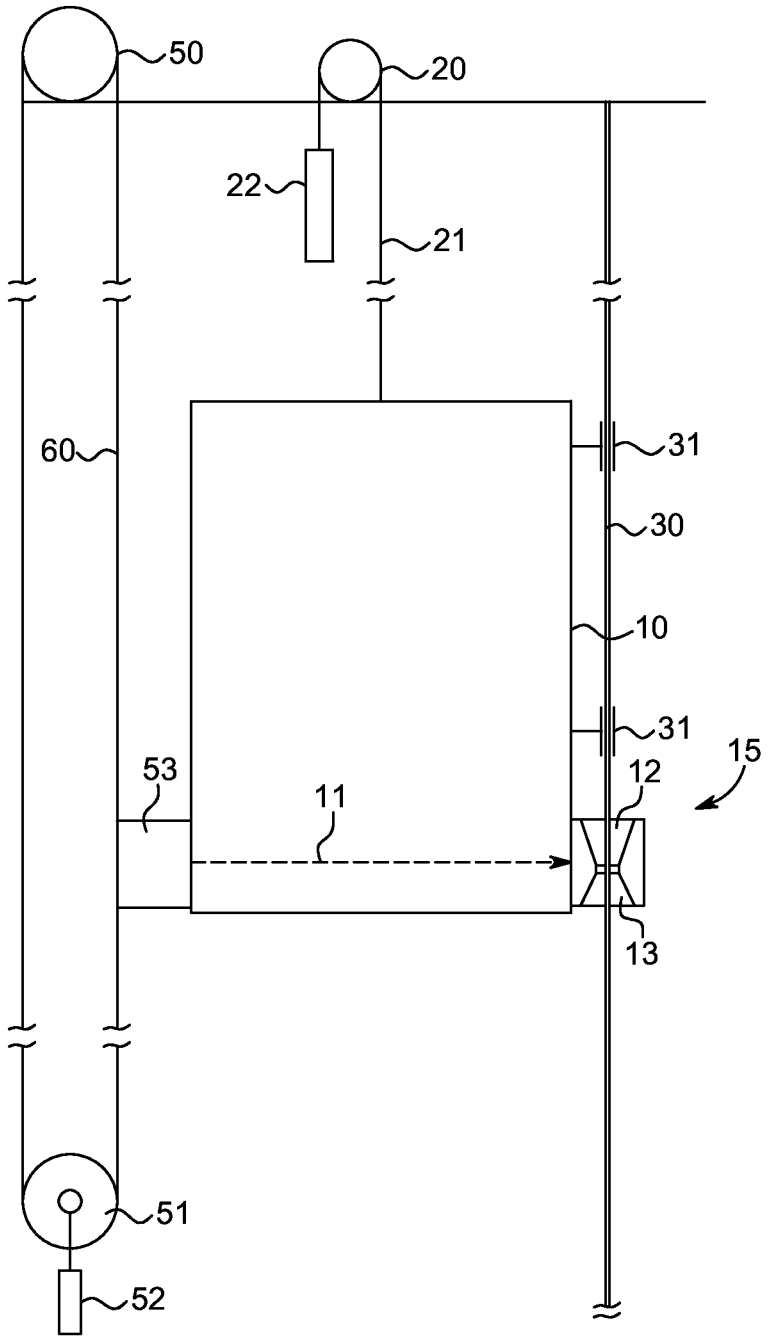
FIG. 1 PRIOR ART
FIG. 1 is a schematic view of an elevator installation having a safety mechanism in accordance with a prior art embodiment.

For purposes of the description hereinafter, the terms "upper", "lower", "right", "left", "vertical", "horizontal", "top", "bottom", "lateral", "longitudinal", and derivatives thereof shall relate to the disclosure as it is oriented in the drawing figures. It is to be understood, however, that the disclosure may assume alternative variations and step sequences, except where expressly specified to the contrary. It is also to be understood that the specific devices and processes illustrated in the attached drawings, and described in the following specification, are simply exemplary embodiments of the disclosure. Hence, specific dimensions and other physical characteristics related to the embodiments disclosed herein are not to be considered as limiting.

Referring to the drawings in which like reference characters refer to like parts throughout the several views thereof, the present disclosure is generally directed to a system and method for an elevator safety mechanism and, more particularly, to a system and method for a governor inertia carrier used in activating an elevator safety mechanism. With reference to FIGS. 2A-2B, the elevator safety mechanism, hereinafter referred to as safety mechanism 100, is configured for mounting to an elevator installation, such as the elevator car 10 shown in FIG. 1. In some embodiments, the safety mechanism 100 may be fixed, such as by fastening, welding, or other mechanical connection means, to at least a portion of the elevator car 10. The safety mechanism 100 is in an inactive state during normal operation of the elevator car 10, such as when the elevator car 10 is operated at or below the limit speed. If the limit speed is reached or exceeded, or if the elevator car 10 is in free fall, the governor assembly of the elevator installation is activated, thereby causing an activation of the safety mechanism 100. In some embodiments, the governor may sense a free fall state before the limit speed is reached. A braking assembly of the safety mechanism 100 engages the rail, such as the guide rail 30 shown in FIG. 1 to bring the elevator car 10 to a stop.

With continued reference to FIGS. 2A-2B, the safety mechanism 100 generally has a housing 102 having a top member 104 separated from a bottom member 106 by a pair of side members 108. At least a portion of the housing 102 is configured for attachment, either directly or indirectly, to the elevator car 10 (shown in FIG. 1). The housing 102 defines a cavity 110 for receiving a braking assembly 112 that is acted upon, directly or indirectly, by the governor rope 60 (shown in FIG. 1). The braking assembly 112 is operable between an inactive state, where the braking assembly is disengaged from contacting the guide rail 30 (shown in FIG. 1), and an active state, where at least a portion of the braking assembly is directly engaged with the guide rail 30, as described herein.

Figure 2A:
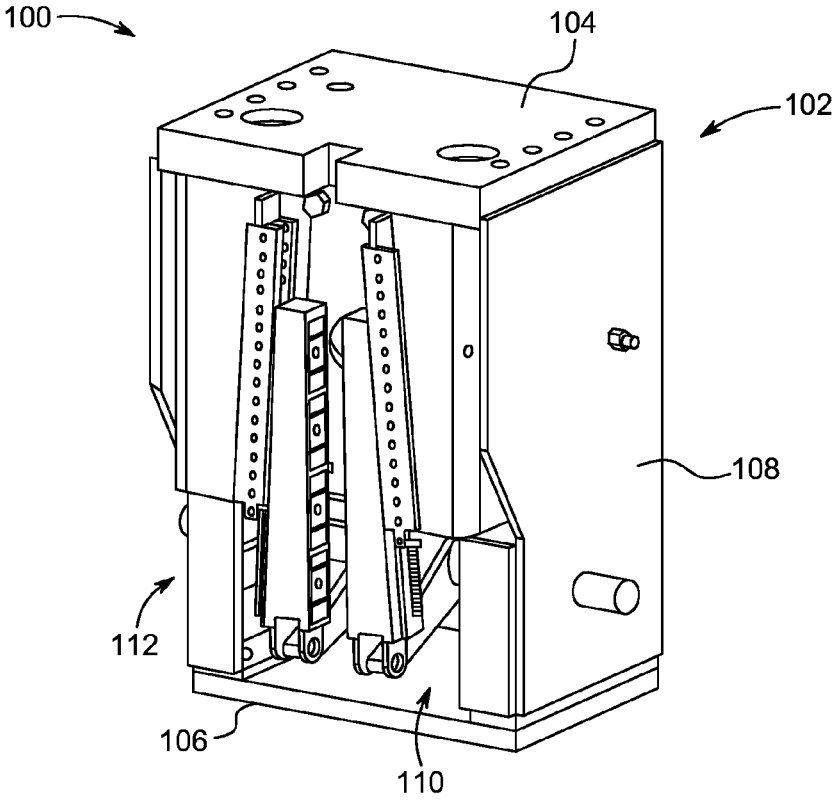
FIG. 2A is a front perspective view of a safety mechanism of an elevator car in accordance with one embodiment of the present disclosure.
Figure 2B:
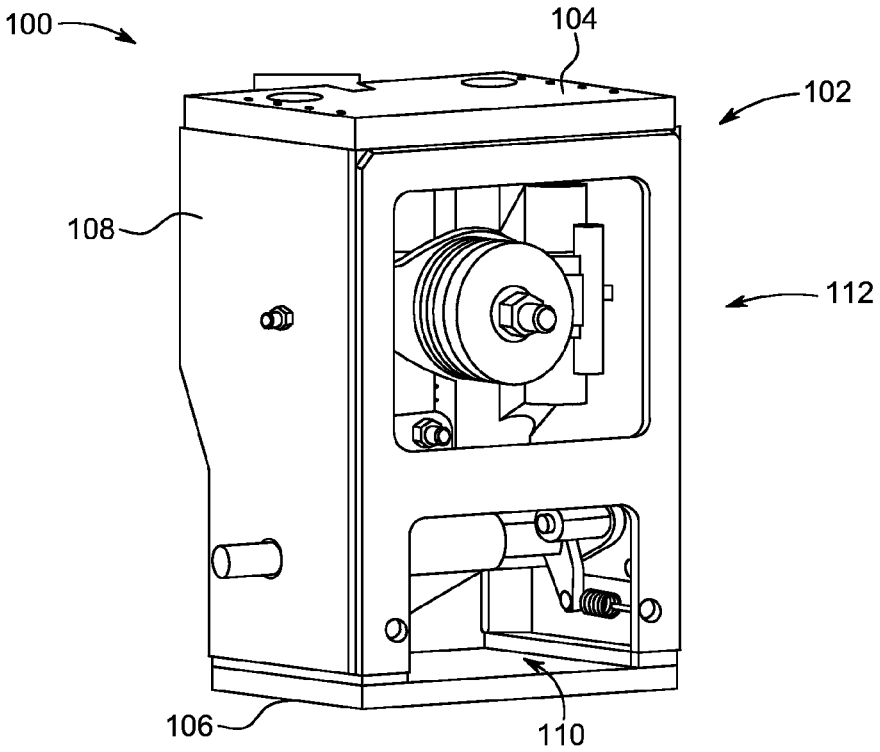
FIG. 2B is a rear perspective view of the safety mechanism shown in FIG. 2A.
Figure 3A:
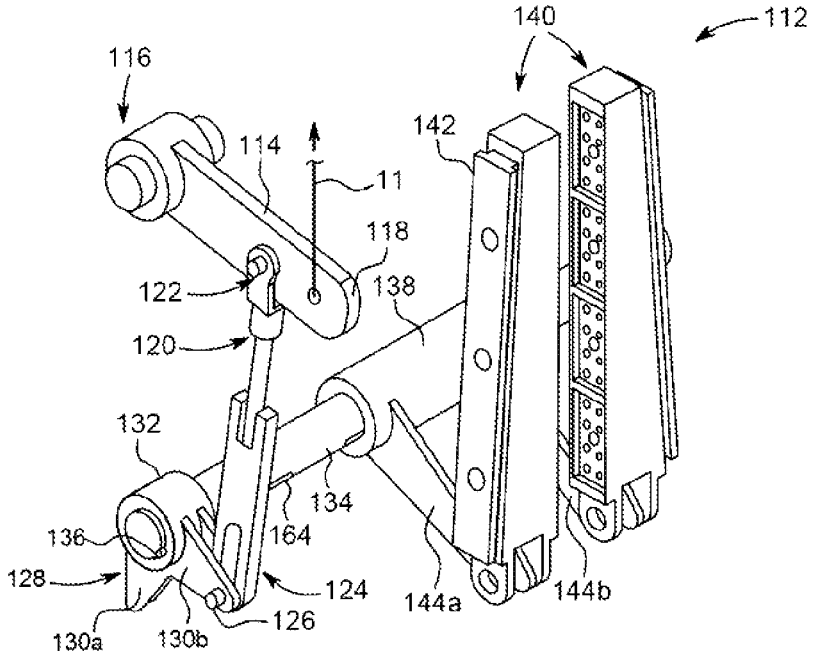
FIG. 3A is a perspective view of a braking assembly for use with the safety mechanism illustrated in FIG. 2, showing the braking assembly in an inactive state.
Figure 3B:
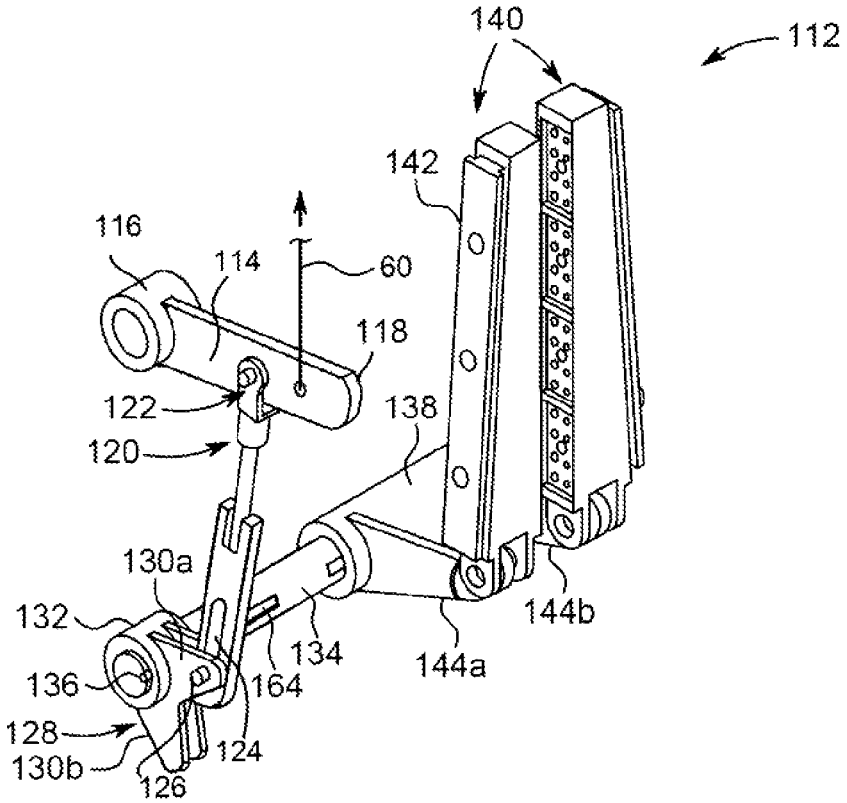
FIG. 3B is a perspective view of the braking assembly of the safety mechanism illustrated in FIG. 3A, showing the braking assembly in an activated state.

With reference to FIGS. 3A-3B, the braking assembly 112 is shown removed from the housing 102. FIG. 3A illustrates the braking assembly 112 in an inactive state, while FIG. 3B illustrates the braking assembly 112 in an active state. The braking assembly 112 has a safety activating lever 114 having a first end 116 pivotally connected to the housing 102 (shown in FIGS. 2A-2B) and a second end 118 connected to at least a portion of the governor assembly, such as the governor rope 60. A clevis rod 120 is connected to the safety activating lever 114 between the first end 116 and the second end 118. In some embodiments, the clevis rod 120 may be connected to the safety activating lever 114 by a pinned connection 122, or other mechanical connection means. The clevis rod 120 has a slotted end 124 opposite the pinned connection 122. The slotted end 124 receives a pin 126 of a wedge lever arm 128 such that the pin 126 is movable within the slotted end 124 of the clevis rod 120 with movement of the clevis rod 120 when the governor rope 60 acts on the safety activating lever 114 in the direction of the arrows in FIGS. 3A-3B. The wedge lever arm 128 has a pair of arms 130*a*, 130*b* connected to a central portion 132 that is keyed to a rotatable shaft 134 by a key 136. In this manner, rotation of the wedge lever arm 128 due to movement of the clevis rod 120 causes a corresponding rotation of the shaft 134. A safety wedge carrier 138 is offset axially from the wedge lever arm 128 along a longitudinal axis of the shaft 134. The safety wedge carrier 138 is also keyed to the shaft 134 such that a rotation of the shaft 134 causes a corresponding rotation of the safety wedge carrier 138. A pair of safety wedges 140 having a braking surface 142 is attached to the safety wedge carrier 138 by arms 144*a*, 144*b*. Rotation of the shaft 134 due to movement of the wedge lever arm 128 causes the safety wedge carrier 138 to rotate, thereby moving the safety wedges 140 from a first, inactive position (shown in FIG. 3A), where the braking surface 142 is disengaged from the guide rail 30 (shown in FIG. 1), to a second, active position (shown in FIG. 3B), where the braking surface 142 engages the guide rail 30 to stop the elevator car 10.

Figure 4:
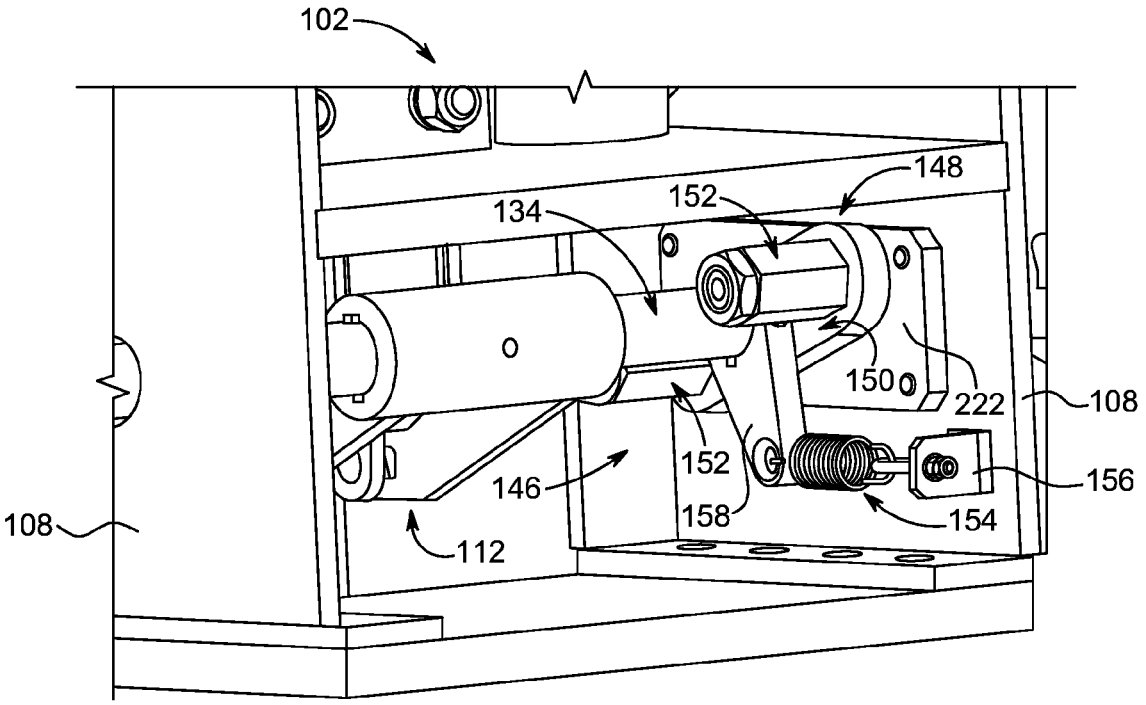
FIG. 4 is a rear perspective view of a braking mechanism of a safety mechanism having a release carrier assembly in accordance with one embodiment of the present disclosure.

With reference to FIG. 4, the shaft 134 is rotatably engaged between the side members 108 of housing 102. In order to prevent unintended activation of the braking assembly 112 during normal operation of the elevator installation due to inertia of the governor assembly pulling on the safety activating lever 114, a governor inertia carrier 146 is provided to resist against the pulling force of the governor assembly up to a predetermined force threshold. Once the predetermined force threshold is reached or exceeded, the resistance from the governor inertia carrier 146 is overcome to allow the braking assembly 112 to be activated.

With continued reference to FIG. 4, the governor inertia carrier 146 has a cartridge assembly 148 having a cartridge plate 150 that is keyed with the shaft 134 for rotation with the shaft 134. The cartridge assembly 148 is pre-loaded against the housing 102 or another component attached to the housing 102. During normal operation of the elevator installation, such as when the operating speed is at or below the limit speed, the force applied to the safety activating lever 114 due to inertia of the governor rope 60 during acceleration of the elevator car is insufficient to overcome the pre-load of the cartridge assembly 148. In this manner, rotation of the shaft 134 and consequent activation of the braking assembly 112 is prevented. If the limit speed of the elevator car is exceeded, or if the elevator car 10 is in free fall, and the governor sheave is locked, the force exerted by the governor rope 60 on the safety activating lever 114 is sufficient to overcome the pre-load of the cartridge assembly 148 and allow the rotation of the shaft 134 and consequent activation of the braking assembly 112 to stop movement of the elevator car 10 (shown in FIG. 1).

In some embodiments, the cartridge assembly 148 may be used in combination with a secondary means for controlling the pre-load force that must be overcome before the braking assembly 112 can be activated. For example, the cartridge assembly 148 may be used in combination with one or more tension springs 154 connected at one end to the housing 102, either directly or by way of a bracket 156 or other element, and at the other end to a spring arm 158 that is keyed with the shaft 134. The one or more tension springs 154 can be used to change the pre-load force by either increasing or decreasing the force that must be applied to the cartridge assembly 148 and the one or more tension springs 154 before the braking assembly 112 can be activated. In some embodiments, the one or more tension springs 154 may have a plurality of tension springs 154 connected in series, parallel, or a combination of both. In other embodiments, the one or more tension springs 154 may be substituted by or supplemented with a hydraulic or pneumatic element (not shown) that can be used to augment the pre-load of the cartridge assembly 148.

With continued reference to FIG. 4, the cartridge assembly 148 has at least one force-exerting element 152 associated with the cartridge plate 150. The at least one force-exerting element 152 exerts a force on at least a portion of the housing 102 or another component connected to the housing 102 to counter the unintended rotation of the shaft 134. In some embodiments, the at least one force-exerting element 152 may have a pre-set force that is not adjustable. In other embodiments, the force exerted by the force-exerting element 152 may be adjustable to select the pre-load force of the force-exerting element 152 that must be overcome before the braking assembly 112 can be activated.

Figure 5:
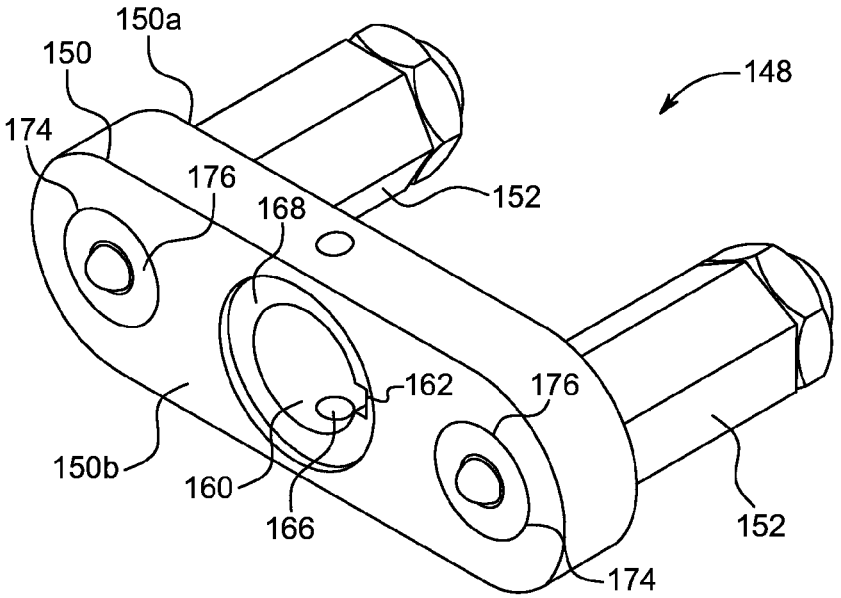
FIG. 5 is a perspective view of a cartridge assembly for use with a braking assembly of a safety mechanism in accordance with one embodiment of the present disclosure.

With reference to FIG. 5, a cartridge assembly 148 is shown isolated from the housing 102 of the safety mechanism 100. The cartridge plate 150 has a top surface 150*a* opposite a bottom surface 150*b*. A shaft opening 160 extends between the top surface 150*a* and the bottom surface 150*b*. The shaft opening 160 may have a key slot 162. The shaft 134 is received within the shaft opening 160 of the cartridge plate 150 such that the key 164 (shown in FIG. 6) on the shaft 134 engages the key slot 162 to allow the cartridge plate 150 to rotate with the shaft 134. The shaft opening 160 is desirably coaxial with a central axis 172 of the shaft 134 (shown in FIG. 6). One or more through holes 166 may extend through the cartridge plate 150 into the shaft opening 160 to allow the cartridge plate 150 to be axially fixed relative to the shaft 134, such as by a retaining element, such as a set screw (not shown), or a similar mechanical fastener. The shaft opening 160 may have a recessed portion 168 configured to provide clearance space for a shaft support element 170, such as a bushing or a bearing, that rotatably supports the shaft 134 to the housing 102 of the safety mechanism 100.

Figure 6:
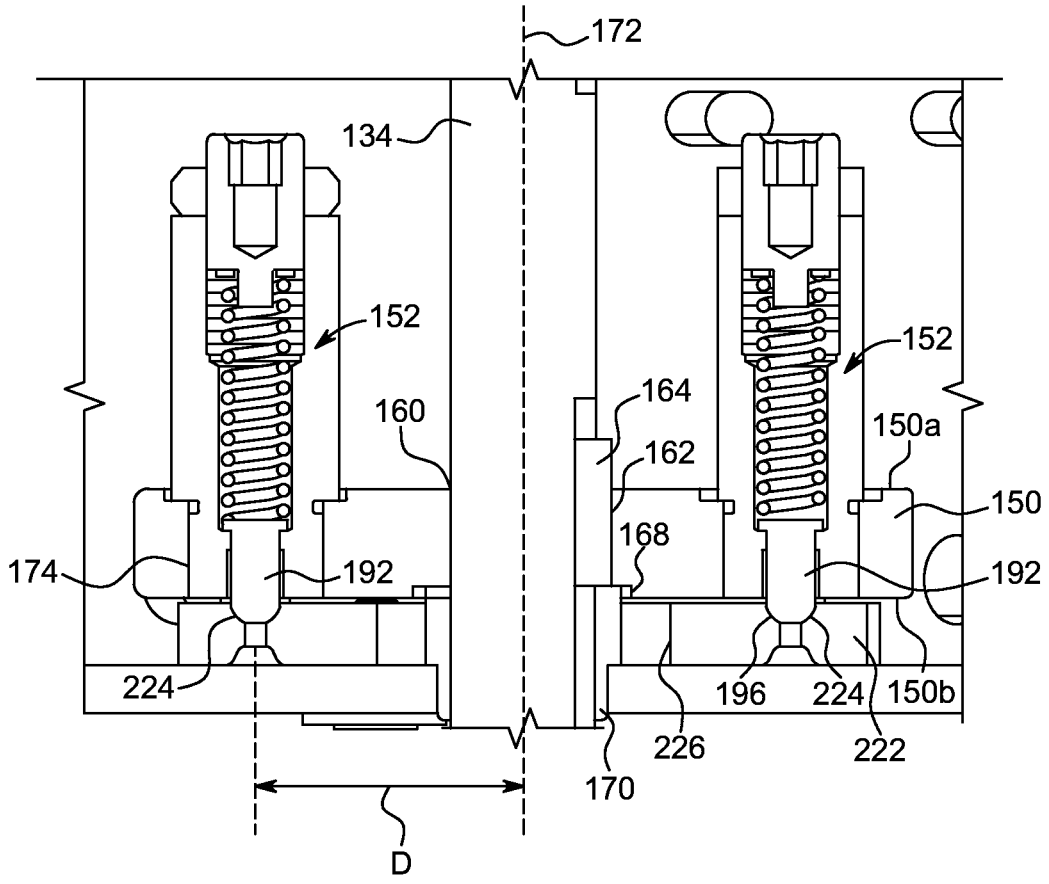
FIG. 6 a cross-sectional view of the cartridge assembly of FIG. 5 installed on the safety mechanism of the elevator car.

With reference to FIG. 6, and with continued reference to FIG. 5, the cartridge plate 150 has at least one side opening 174 that is offset from the shaft opening 160. In some embodiments, the cartridge plate 150 may have a pair of side openings 174 offset radially on opposing sides of the shaft opening 160. The one or more side openings 174 may be provided at a distance D away from the shaft opening 160. In some embodiments, a central axis of the one or more side openings 174 may be parallel with the central axis of the shaft opening 160. Each side opening 174 receives at least a portion of the force-exerting element 152. At least a portion of each force-exerting element 152 protrudes from the top surface 150*a* and/or the bottom surface 150*b* of the cartridge plate 150. In some embodiments, each force-exerting element 152 is removably or non-removably connected to the cartridge plate 150. For example, the one or more force-exerting elements 152 may be connected to the respective side openings 174 on the cartridge plate by a threaded connection 176 such that the one or more force-exerting elements 152 may be removed from the respective side openings 174. In other embodiments, the one or more force-exerting elements 152 may be permanently and non-removably connected to the cartridge plate 150, such as by adhesive means, an interference fit, or other mechanical connection means. In further embodiments, the one or more force-exerting elements 152 may be monolithically formed with the cartridge plate 150.

Figure 7:
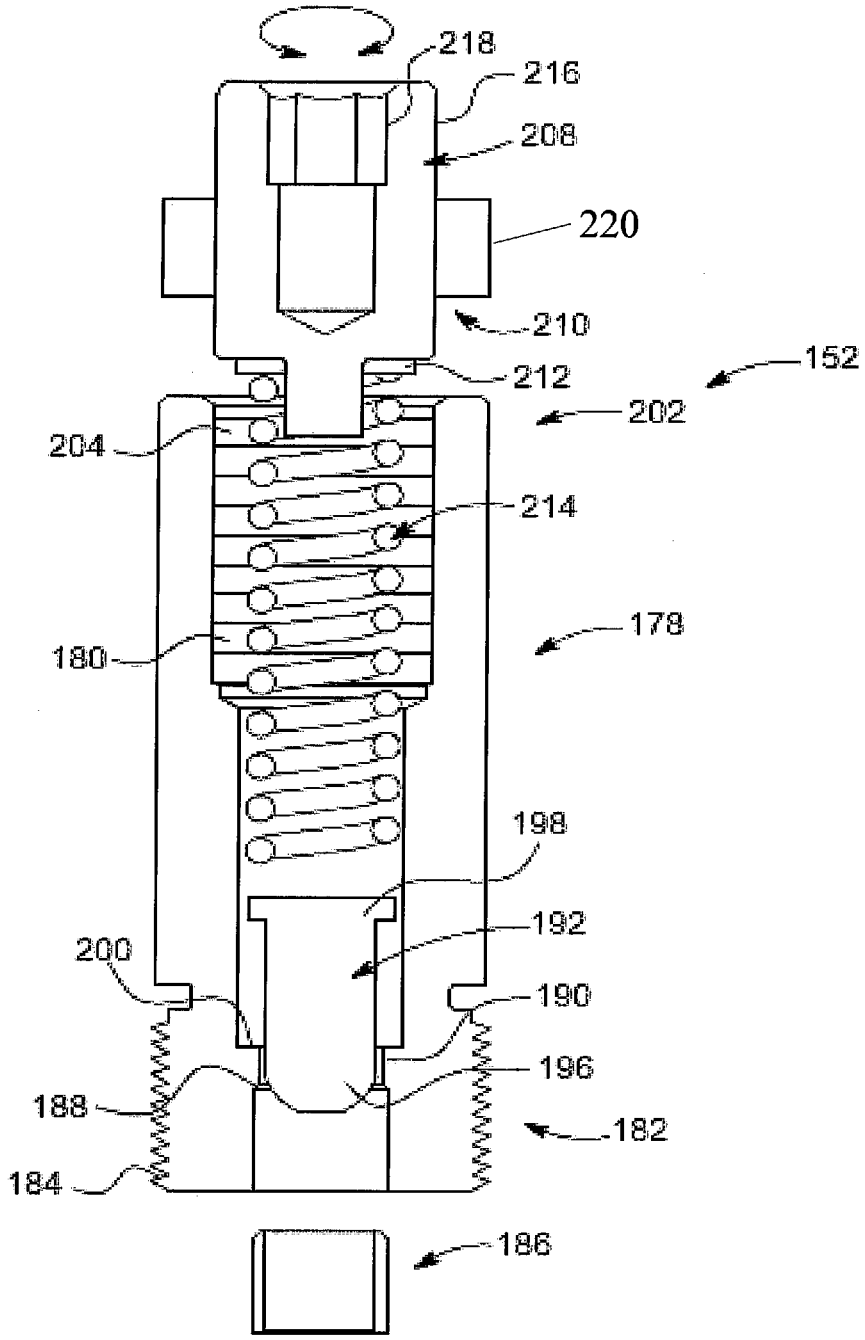
FIG. 7 is a cross-sectional, partially exploded view of a cartridge of the cartridge assembly shown in FIG. 6.

With reference to FIG. 7, the force-exerting element 152 has a hollow, substantially cylindrical body 178 with an internal cavity 180. The body 178 has a first end 182 that is configured for being received within at least a portion of the side opening 174. The first end 182 may have a male thread 184 on an outer circumference of the body 178 that engages a corresponding female thread on the side opening 174 to form the threaded connection 176. The first end 182 may have a bushing 186 within at least a portion of the internal cavity 180. A portion of the internal cavity 180 may have a collar 190 that narrows in a radial direction relative to a sidewall of the internal cavity 180 to define a first stop surface 188 that engages the bushing 186 to prevent axial movement of the bushing 186 into the internal cavity 180. The bushing 186 may be retained within the internal cavity 180 by an interference fit, or other mechanical connection, to prevent the bushing 186 from sliding out of the internal cavity 180.

With continued reference to FIG. 7, the collar 190 and/or the bushing 186 define a guide path for a contact member, such as a pin 192, that is axially movable relative to the body 178. The pin 192 has a pin body 194 with a rounded front end 196 and a rear lip 198 that protrudes radially outward relative to the pin body 194. The rear lip 198 engages the collar 190 at a second stop surface 200 to prevent the pin 192 from being removed from the internal cavity 180 through the first end 182. The pin 192 is movable axially within the internal cavity 180 such that at least a portion of the pin 192 may protrude relative to a plane defined by a terminal surface of the first end 182. In some embodiments, when the rear lip 198 of the pin 192 engages the collar 190, the rounded front end 196 protrudes from the first end 182 of the body 178. In some embodiments, the pin 192 may have a spherical shape.

A second end 202 of the body 178 is provided opposite the first end 182. The second end 202 has one or more first threads 204 formed on the sidewall of the internal cavity 180 for threadably engaging one or more second threads 206 on an adjustment element 208. The adjustment element 208 has a first end 210 having a seat 212 for engaging one end of a resiliently elastic element, such as a spring 214 provided within the internal cavity 180 of the body 178. The opposing end of the spring 214 engages at least a portion of the pin 192, such as the lip 198 of the pin 192. In some embodiments, the pin 192 may be formed with the spring 214. For example, the pin 192 may be monolithically formed at the terminal end of the spring 214. A second end 216 of the adjustment element 208 has a socket 218 for engaging an adjustment tool (not shown), such as a wrench or a key, for adjusting the position of the adjustment element 208 within the internal cavity 180 of the body 178. In some embodiments, the spring 214 may be a linear spring, a progressive spring, a torsion spring, a volute spring, a leaf spring, a Belleville spring, or any other resiliently elastic member. In other embodiments, the springs 214 may be replaced with a pneumatically or hydraulically charged cylinder having fluid that exerts a force on the pins 192. The stiffness of the spring 214 may be pre-selected based on the desired pre-loading of the pins 192, or the force that is necessary to unseat the pin 192 from the collar 190, that is desired.

The longitudinal position of the adjustment element 208 within the internal cavity 180 can be adjusted by rotating the adjustment element 208 relative to the body 178. For example, rotating the adjustment element 208 in a first direction, such as a clockwise direction, may move the adjustment element 208 from the second end 202 of the body 178 toward the first end 182. Conversely, rotating the adjustment element 208 in a second direction which is opposite to the first direction, such as a counter-clockwise direction, may move the adjustment element 208 from the first end 182 of the body 178 toward the second end 202. Position of the adjustment element 208 within the internal cavity 180 controls the compression of the spring 214. For example, moving the adjustment element 208 toward the first end 182 of the body 178 (i.e., tightening the adjustment element 208) increases the compression of the spring 214 and the amount of force the spring 214 exerts on the pin 192. In other words, compression of the spring 214 increases the force that must be exerted on the pin 192 to displace the pin 192 toward the second end 202 of the body 178 in order to compress the spring 214. Conversely, moving the adjustment element 208 toward the second end 202 of the body 178 (i.e., loosening the adjustment element 208) decreases the compression of the spring 214 and the amount of force the spring 214 exerts on the pin 192. A locking element, such as a lock nut 220, may be provided to prevent movement of the adjustment element 208 once a desired position is set. The lock nut 220 may be threaded onto the adjustment element 208 such that the lock nut 220 engages the second end 202 of the body 178 when fully tightened. Various other locking devices may be provided to prevent the adjustment element 208 from inadvertently moving from its set position.

Referring back to FIG. 6, the cartridge assembly 148 is positioned such that the shaft 134 extends through the shaft opening 160 and the bottom surface 150*b* of the cartridge plate 150 engages a detent plate 222 that is attached to the housing 102. The detent plate 222 is substantially planar and has one or more detents 224 extending inwardly into the body of the detent plate 222. Each detent 224 is shaped to receive at least a portion of the pin 192 of the force-exerting element 152. Desirably, the number of detents 224 corresponds to the number of pins 192. In some embodiments, each detent 224 may have a cavity, such as a rounded cavity, a countersink, or a through hole, configured to receive at least a portion of the rounded front end 196 of the pin 192. While FIG. 6 illustrates that the one or more detents 224 are formed on a detent plate 222 that is attached to the housing 102, in other embodiments the one or more detents 224 may be formed directly on the housing 102. The detent plate 222 has a shaft opening 226 for receiving the shaft 134 therethrough. While the cartridge assembly 148 is keyed to the shaft 134 for rotation with the shaft 134 and relative to the housing 102, the detent plate 222 is fixed to the housing 102 and does not rotate with the rotation of the shaft 134.

Figure 8A:
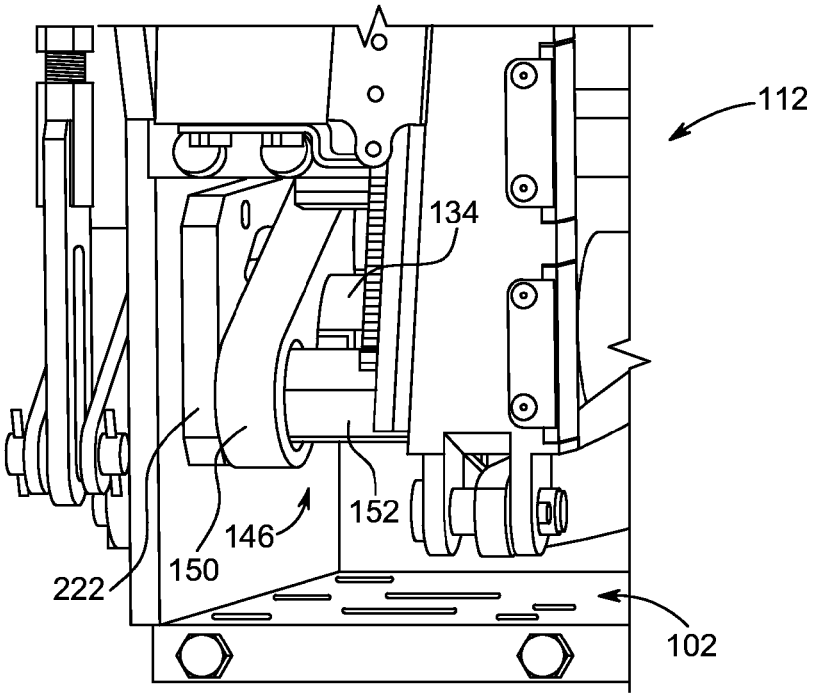
FIG. 8A is a perspective view of the braking assembly of the safety mechanism illustrated in FIG. 4, showing the braking assembly is an inactive state.
Figure 8B:
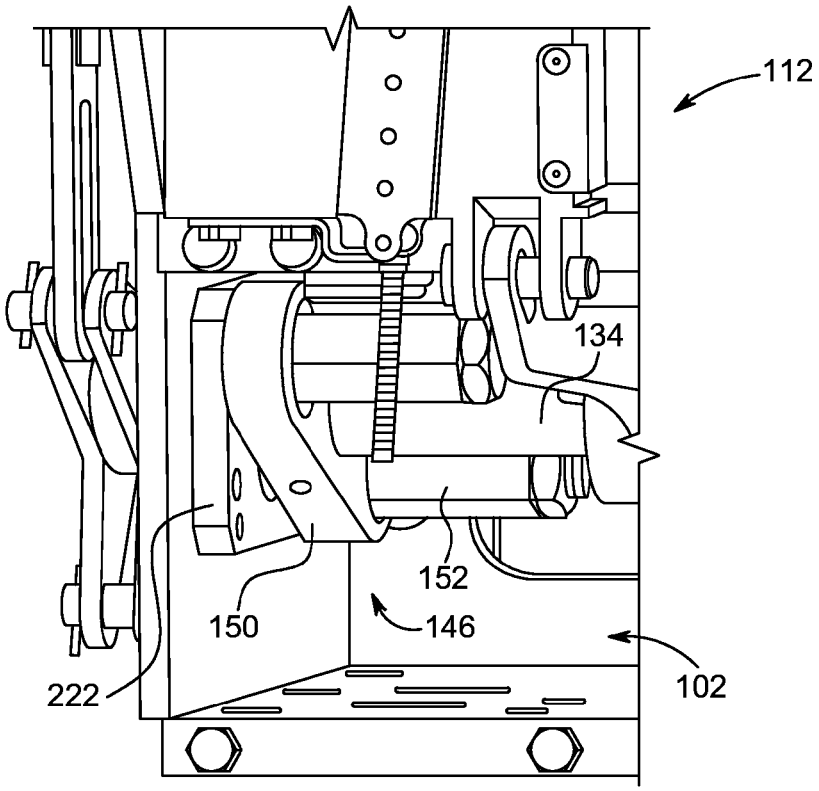
FIG. 8B is a perspective view of the braking assembly of the safety mechanism illustrated in FIG. 8A, showing the braking assembly is an activated state.

The governor inertia carrier 146, the housing 102, and/or the detent plate 222 may be made from any high-strength material having desirable strength, wear, and anti-corrosion properties. In some embodiments, the governor inertia carrier 146, the housing 102, and/or the detent plate 222 may be made from metal or plastic. Non-limiting examples of materials suitable for use in forming the governor inertia carrier 146, the housing 102, and/or the detent plate 222 include, but are not limited to, the art-recognized metals, such as high strength steel, stainless steel, aluminum, and alloys thereof, and art recognized high-strength plastics, such as nylon composites, and ultra-high molecular weight polyethylene. Various coatings or surface treatments may be applied to any surface of the governor inertia carrier 146, the housing 102, and/or the detent plate 222. For example, various surfaces of the governor inertia carrier 146, the housing 102, and/or the detent plate 222 may be chrome plated, nickel plated, or heat treated for localized hardening. With reference to FIGS. 8A-8B, the braking assembly 112 is shown in an inactive state (FIG. 8A), where the braking assembly 112 is disengaged from the rail 30 (shown in FIG. 1), and an active state (FIG. 8B), where the braking assembly 112 is engaged with the rail 30 (shown in FIG. 1). In an inactive state, the governor inertia carrier 146 is positioned such that one or more pins 192 of the cartridge assembly 148 (shown in FIG. 6) are received within the corresponding one or more detents 224. In this configuration, rotation of the cartridge assembly 148 caused by the rotation of the shaft 134 due to the inertia of the governor rope 60 (shown in FIG. 1) pulling on safety activating lever 114, is resisted by the pins 192 and their relative positioning within the detents 224. In some embodiments, the rotation of the cartridge assembly 148 can be further resisted by one or more tension springs 154 or other mechanical means used in combination with the cartridge assembly 148. During normal operation of the elevator assembly, such as when the elevator car 10 is operated at or below the limit speed, the cartridge assembly 148 provides sufficient resisting force to prevent rotation of the shaft 134, and subsequent activation of the braking assembly 112, due to the engagement of the pins 192 within the detents 224. The pre-load of the springs 214, that is the force that is necessary to unseat the pins 192 from the collar 190 due to movement of the pins 192 toward the second end 202 of the body 178 through spring compression, can be controlled by adjusting the position of the adjustment element 208 within the body 178. The stiffness of the springs 214 and the geometry of the rounded cavity of the detents 224 (such as, for example, a countersink angle) further contributes to the overall force that is necessary to unseat the pins 192 from the detents 224. The pin 192 may retract out of the detent 224 when a force less than, equal to, or greater than a spring-load force of the spring 214 is applied to the pin 192. The governor inertia carrier 146 is provided to resist against the pulling force of the governor assembly up to a predetermined force threshold, as determined by the preload of the force-exerting elements 152. Once the predetermined force threshold is reached or exceeded, the resistance from the governor inertia carrier 146 is overcome to allow the braking assembly 112 to be activated.

When the limit speed of the elevator installation is reached or exceeded, the governor rope 60 is stopped due to the locking of the governor sheave 50 (FIG. 1). This causes the governor rope 60 to move the safety activating lever 114 and thereby initiates the rotation of the shaft 134. While the governor inertia carrier 146 exerts a sufficient force through engagement of the pins 192 with the detents 224 during normal operating conditions, the force of the governor rope 60 suddenly pulling on the safety activating lever 114 is sufficient to overcome the holding force of the pins 192. In this manner, the shaft 134 is rotated, causing the pins 192 to ride along the detent 224 sidewall, which moves the pins 192 toward the second end 202 of the body 178. The torque exerted by the safety activating lever 114 on the shaft 134 is sufficient to displace the pins 192 from the detents 224 such that the pins 192 are at least partially withdrawn within the body 178 of the force-exerting element 152. The shaft 134 can then rotate until the braking assembly 112 is engaged, as shown in FIG. 8B. Once the elevator car 10 is safely brought to a stop, the governor inertia carrier 146 can be reset by rotating the shaft 134 until the pins 192 are seated within the detents 224. The tension springs 154 may assist in resetting the governor inertia carrier 146 to its inactive state.

Although the disclosure has been described in detail for the purpose of illustration based on what is currently considered to be the most practical and preferred embodiments, it is to be understood that such detail is solely for that purpose and that the disclosure is not limited to the disclosed embodiments, but, on the contrary, is intended to cover modifications and equivalent arrangements. For example, it is to be understood that the present disclosure contemplates that, to the extent possible, one or more features of any embodiment can be combined with one or more features of any other embodiment.

What is claimed:

1. An elevator safety mechanism comprising:

a housing at least partially surrounding at least one of a wedge carrier and wedge arms of the safety mechanism;

a cartridge installed within the housing and having a shaft opening for receiving a shaft through the shaft opening, the cartridge configured for fixed attachment to the shaft; and at least one force-exerting element associated with the cartridge and offset from the shaft opening, the at least one force-exerting element comprising:

a hollow body having an internal cavity extending between a first open end and a second end;

an elastically-resilient element retained within the internal cavity;

a contact member at least partially disposed within the internal cavity and in contact with or formed on an end of the elastically-resilient element; and a detent plate facing the first open end of the hollow body, the detent plate comprising at least one detent shaped to receive the contact member wherein the detent comprises a contact area, wherein the contact member further engages the contact area located on the detent plate, wherein the contact member is retractable into the internal cavity to compress the elastically-resilient element and to disengage from the contact area when a force greater than a restoring force of the elastically-resilient element is applied to the contact member, and wherein the detent plate is fixedly mounted to the housing and wherein the shaft and the cartridge are rotatable relative to the housing and the detent plate.

2. The elevator safety mechanism of claim 1, wherein the second end of the hollow body of the force-exerting element is open and wherein the second end is enclosed by an adjustment element that is movably adjustable relative to the hollow body and in contact with a second end of the elastically-resilient element to control compression of the elastically-resilient element between the adjustment element and the contact member.

3. The elevator safety mechanism of claim 2, wherein the adjustment element has a seat for contacting the elastically-resilient element at a first end of the adjustment element and a socket for engaging an adjustment tool at a second end of the the adjustment element.

4. The elevator safety mechanism of claim 2, wherein the adjustment element is movable toward the first end of the hollow body by rotating the adjustment element in a first direction to increase the compression of the elastically-resilient element, and wherein the adjustment element is movable toward the second end of the hollow body by rotating the adjustment element in a second direction opposite to the first direction to decrease the compression of the elastically-resilient element.

5. The elevator safety mechanism of claim 2, further comprising a locking element for preventing rotatable movement of the adjustment element relative to the hollow body when the locking element engages at least a portion of the hollow body and the adjustment element.

6. The elevator safety mechanism of claim 1, wherein the contact member has a body rounded front end that is extendable from the first end of the hollow body and a radially-outwardly protruding lip that is retained within the internal cavity of the hollow body.

7. The elevator safety mechanism of claim 6, further comprising a collar that protrudes radially-inward from a sidewall of the internal cavity.

8. The elevator safety mechanism of claim 7, wherein the collar has a stop surface that limits a protrusion of the contact member from the first end of the hollow body.

9. The elevator safety mechanism of claim 1, wherein, in an inactive state, the contact member is engaged within the detent, and wherein, in an active state, rotation of the cartridge relative to the detent plate forces the contact member out of the detent and at least partially into the internal cavity of the hollow body.

10. The elevator safety mechanism of claim 1, wherein the restoring force of the elastically-resilient element is preset.

11. The elevator safety mechanism of claim 1, wherein the restoring force of the elastically-resilient element is adjustable.

12. The elevator safety mechanism of claim 1, wherein the cartridge has one or more through holes extending into the shaft opening, and wherein a retention member is provided in each through hole for engaging at least a portion of the shaft and preventing axial movement of the cartridge on the shaft.

13. The elevator safety mechanism of claim 1, wherein the shaft opening has a recessed portion for receiving a shaft support element.

14. The elevator safety mechanism of claim 1, wherein the at least one force-exerting element is removably connected to the cartridge.

15. The elevator safety mechanism of claim 1, wherein the at least one force-exerting element is non-removably connected to the cartridge.

16. The elevator safety mechanism of claim 1, further comprising the shaft received within the shaft opening of the cartridge.

17. A safety mechanism for an elevator, the safety mechanism comprising:

a housing attachable to at least a portion of an elevator car and at least partially surrounding at least one of a wedge carrier and wedge arms of the safety mechanism;

a safety activation lever connecting a governor assembly to a rotatable shaft disposed within the housing;

a braking assembly activated by a rotation of the shaft; and a governor inertia carrier associated with the shaft and the housing, the governor inertia carrier comprising:

a cartridge installed within the housing and having a shaft opening for receiving the shaft through the shaft opening, the cartridge configured for fixed attachment to the shaft; and at least one force-exerting element associated with the cartridge, the at least one force-exerting element comprising:

a hollow body having an internal cavity extending between a first open end and a second end;

an elastically-resilient element retained within the internal cavity; and a contact member at least partially disposed within the internal cavity, a first end of the contact member in contact with or formed on the elastically-resilient element and a second end of the contact member received in at least one detent formed in a detent plate facing the first open end of the hollow body, the at least one detent shaped to receive the contact member, wherein the contact member is retractable out of the detent and into the internal cavity when a force greater than a restoring force of the elastically-resilient element is applied to the contact member, and wherein the detent plate is fixedly mounted to the housing and wherein the shaft and the cartridge are rotatable relative to the housing and the detent plate.

* * * * *